US011387024B2

(12) United States Patent
Kawamura et al.

(10) Patent No.: US 11,387,024 B2
(45) Date of Patent: Jul. 12, 2022

(54) R-T-B BASED RARE EARTH SINTERED MAGNET AND METHOD OF PRODUCING R-T-B BASED RARE EARTH SINTERED MAGNET

(71) Applicant: TDK CORPORATION, Tokyo (JP)

(72) Inventors: Hiroki Kawamura, Tokyo (JP); Makoto Iwasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/207,950

(22) Filed: Mar. 22, 2021

(65) Prior Publication Data

US 2021/0296029 A1 Sep. 23, 2021

(30) Foreign Application Priority Data

Mar. 23, 2020 (JP) ..... JP2020-051883

(51) Int. Cl.

| | |
|---|---|
| ***H01F 1/057*** | (2006.01) |
| ***C22C 38/16*** | (2006.01) |
| ***C22C 38/14*** | (2006.01) |
| ***C22C 38/06*** | (2006.01) |
| ***C22C 38/00*** | (2006.01) |
| ***C22C 38/10*** | (2006.01) |
| ***C22C 30/02*** | (2006.01) |
| ***H01F 41/02*** | (2006.01) |

(52) U.S. Cl.

CPC ..... *H01F 1/0577* (2013.01); *C22C 30/02* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 41/0266* (2013.01); *C22C 2202/02* (2013.01)

(58) Field of Classification Search

CPC ..... H01F 1/0577; C22C 30/02; C22C 38/002; C22C 38/005; C22C 38/06; C22C 38/10; C22C 38/14; C22C 38/16; C22C 2202/02

USPC ..... 252/62.51 R

See application file for complete search history.

(56) References Cited

U.S. PATENT DOCUMENTS

2019/0371522 A1* 12/2019 Kuniyoshi ..... C22C 28/00

FOREIGN PATENT DOCUMENTS

JP 2006-210893 A 8/2006

* cited by examiner

*Primary Examiner* — Humera N. Sheikh
*Assistant Examiner* — Katherine A Christy
(74) *Attorney, Agent, or Firm* — Oliff PLC

(57) ABSTRACT

An R—T—B based rare earth sintered magnet in which R is a rare earth sintered magnet, T is an iron group element, and B is boron. R includes one or more selected from Nd and Pr. The R—T—B based rare earth sintered magnet includes M and C in which M is one ore more selected from Zr, Ti, and Nb. The R—T—B based rare earth sintered magnet includes main phase grains and grain boundaries, and the grain boundaries includes a coexisting part in which a M—C compound, a M—B compound, and a 6-13-1 phase coexist. The R—T—B based rare earth sintered magnet attains improved HcJ while maintaining good Br and Hk/HcJ.

5 Claims, 2 Drawing Sheets

R-T-B BASED RARE EARTH SINTERED MAGNET AND METHOD OF PRODUCING R-T-B BASED RARE EARTH SINTERED MAGNET

TECHNICAL FIELD

The present disclosure relates to an R—T—B based rare earth sintered magnet and a method of producing the R—T—B based rare earth sintered magnet.

BACKGROUND

Patent Document 1 discloses an Nd—Fe—B based rare earth permanent magnet in which at least two selected from an M—B based compound, an M—B—Cu based compound, and an M—C based compound, in addition to R oxides are finely precipitated in an alloy composition. Patent Document 1 discloses that an object of the invention is to attain a suppressed abnormal grain growth, a wider optimum sintering temperature, and good magnetic properties.

[Patent Document 1] JP Patent Application Laid Open No. 2006-210893

SUMMARY

An object of an aspect of the present invention is to improve HcJ while maintaining good Br and Hk/HcJ.

In response to the above object, an R—T—B based rare earth sintered magnet according to an aspect of the present invention is an R—T—B based rare earth sintered magnet having M and C in which R is a rare earth element, T is an iron group element, and B is boron, wherein R includes one or more selected from Nd and Pr;

M is one or more selected from Zr, Ti, and Nb; and the R—T—B based rare earth sintered magnet includes main phase grains and grain boundaries, and the grain boundaries include a coexisting part in which an M—C compound, an M—B compound, and a 6-13-1 phase coexist.

The R—T—B based rare earth sintered magnet according to an aspect of the present invention can improve HcJ while maintaining good Br and Hk/HcJ by having the above-mentioned constitution.

In the R—T—B based rare earth sintered magnet, with respect to 100 mass % of the R—T—B based rare earth sintered magnet, a total content of R may be 28.00 mass % or more and 34.00 mass % or less;

Co content may be 0.05 mass % or more and 3.00 mass % or less;

B content may be 0.70 mass % or more and 0.95 mass % or less;

C content may be 0.07 mass % or more and 0.25 mass % or less;

Cu content may be 0.10 mass % or more and 0.50 mass % or less;

Ga content may be 0.20 mass % or more and 1.00 mass % or less;

Al content may be 0.10 mass % or more and 0.50 mass % or less;

a total content of M is 0.20 mass % or more and 2.00 mass % or less; and a total content of heavy rare earth elements may be 0.10 mass % or less (including 0).

An area ratio of the coexisting part in one cross section of the R—T—B based rare earth sintered magnet may be 0.10% or more and 15.00% or less.

A total area ratio of the M—B compound and the M—C compound in the coexisting part may be 40% or more and 75% or less, and an area ratio of the 6-13-1 phase in the coexisting part may be 25% or more and 60% or less.

In the coexisting part, an area ratio of the M—C compound may be 30% or more and 70% or less and an area ratio of the M—B compound may be 5% or more and 10% or less.

A method of producing the R—T—B based rare earth sintered magnet according to another aspect of the present invention includes steps of obtaining an alloy powder having a grain size of several μm or so by pulverizing a raw material alloy, and adding a powder including M in a form of simple substance to the alloy powder in which M is one or more selected from Zr, Ti, and Nb.

The R—T—B based rare earth sintered magnet produced by the above-mentioned method tends to easily include the above-mentioned coexisting part. Further, the R—T—B based rare earth sintered magnet tends to easily improve HcJ while maintaining good Br and Hk/HcJ.

A total added amount of M may be 0.50 parts by mass or more and 1.40 parts by mass or less with respect to 100 parts by mass of the alloy powder.

C content in the raw material alloy may be 0.01 mass % or more.

DETAILED DESCRIPTION

Figure 1:
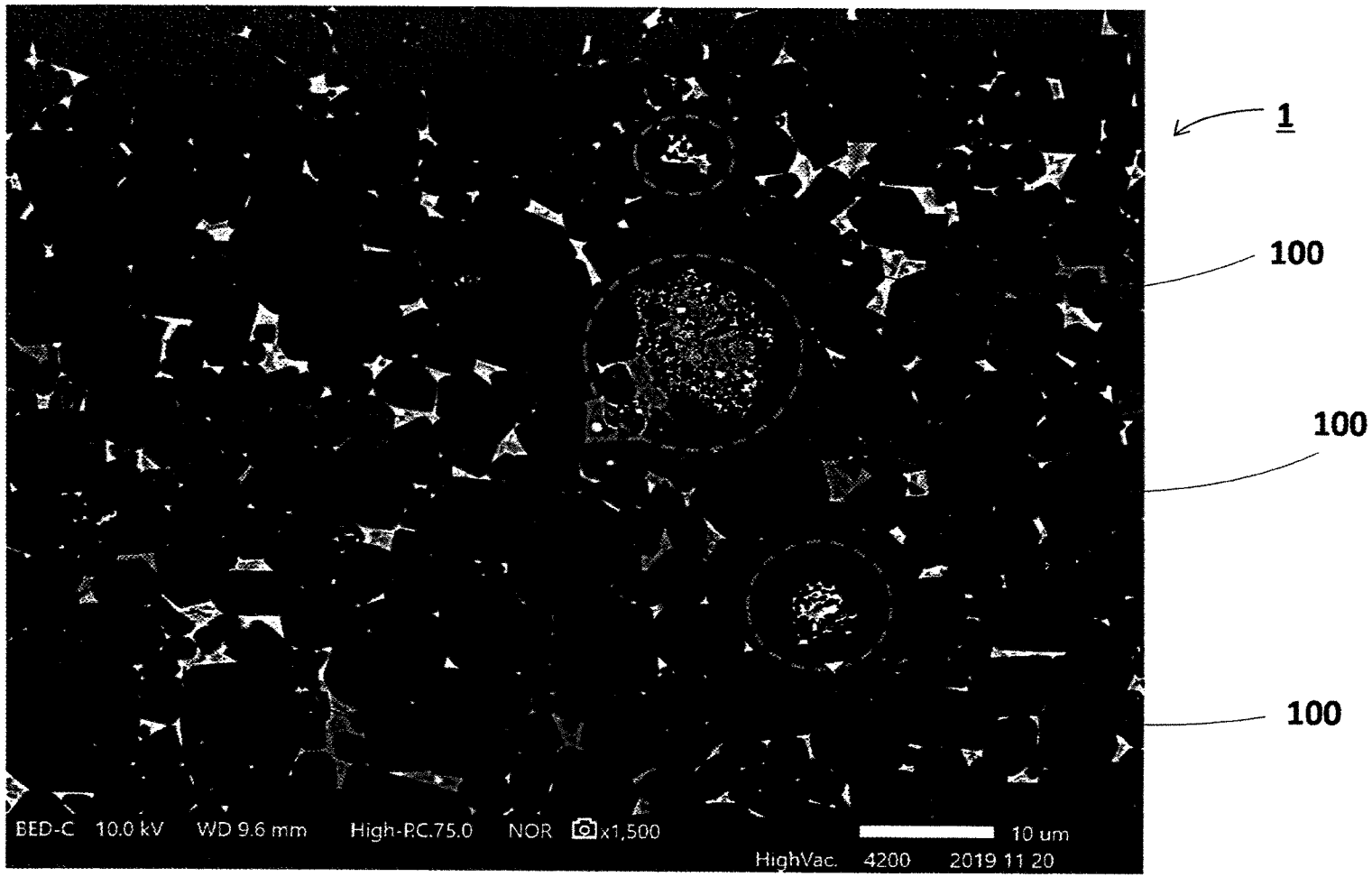
FIG. 1 is an SEM image of Example 5.

Hereinafter, embodiments of the present invention will be described below.

R—T—B Based Rare Earth Sintered Magnet

An R—T—B based rare earth sintered magnet according to the present embodiment is described.

R is one or more selected from rare earth elements. In order to suitably control a production cost of the R—T—B based rare earth sintered magnet and magnetic properties of the R—T—B based rare earth sintered magnet, R may include one or more selected from neodymium (Nd) and praseodymium (Pr). Further, R may include one or more selected from cerium (Ce) and lanthanum (La).

T is an iron group element. T may be iron (Fe) or a combination of Fe and cobalt (Co). B is boron. The R—T—B based rare earth sintered magnet includes M and carbon (C). M is one or more selected from zirconium (Zr), titanium (Ti), and niobium (Nb). When M as a whole is 100 mass %, 80 mass % or more of Zr may be included, and M may be substantially Zr only. Note that, M is substantially Zr only means that a content ratio of Zr is 99 mass % or more in 100 mass % of M as a whole.

A content of each element in the R—T—B based rare earth sintered magnet is not particularly limited. A total content of R may be 28.00 mass % or more and 34.00 mass % or less, or it may be 29.55 mass % or more and 31.01 mass % or less when the R—T—B based rare earth sintered magnet as a whole is 100 mass %. A total content of Nd, Pr, Dy, and Tb may be 28.00 mass % or more and 34.00 mass % or less.

A total content of Nd and Pr may be 28.00 mass % or more and 34.00 mass % or less, or it may be 29.55 mass % or more and 31.01 mass % or less when the R—T—B based rare earth sintered magnet as a whole is 100 mass %. By having the total content of Nd and Pr within the above-mentioned range, suitable magnetic properties tend to be obtained easily.

B content in the R—T—B based rare earth sintered magnet may be 0.70 mass % or more and 0.95 mass % or less, or may be 0.82 mass % or more and 0.94 mass % or less. By having B content within the above-mentioned range, suitable squareness ratio Hk/HcJ and production stability tend to be obtained easily.

Fe content in the R—T—B based rare earth sintered magnet may be 55.00 mass % or more and 75.00 mass % or less, or may be 55.00 mass % or more and 70.58 mass % or less.

Co content in the R—T—B based rare earth sintered magnet may be 0.05 mass % or more and 3.00 mass % or less, may be 0.50 mass % or more and 2.50 mass % or less, or may be 1.00 mass % or more and 2.00 mass % or less. By having Co content within the above-mentioned range, a corrosion resistance tends to be improved easily while suppressing the increasing production cost.

A total content of M in the R—T—B based rare earth sintered magnet is not particularly limited, and for example it may be 0.20 mass % or more and 2.00 mass % or less, may be 0.21 mass % or more and 1.89 mass % or less, may be 0.21 mass % or more and 1.60 mass % or less, or may be 0.21 mass % or more and 1.40 mass % or less. As the total content of M decreases, an area ratio of the coexisting part which is described below becomes smaller, and an effect of improving HcJ while maintaining good Br and Hk/HcJ tends to become difficult to attain. As the total content of M increases, the area ratio of the coexisting part increases, and Br and Hk/HcJ tend to decrease easily.

The R—T—B based rare earth sintered magnet may include copper (Cu) or may not include Cu. Cu content may be 0.10 mass % or more and 0.50 mass % or less, or may be 0.19 mass % or more and 0.30 mass % or less. As Cu content decreases, the corrosion resistance of the R—T—B based rare earth sintered magnet tends to decrease easily. As Cu content increases, Br of the R—T—B based rare earth sintered magnet tends to decrease easily.

The R—T—B based rare earth sintered magnet may include gallium (Ga) or may not include Ga. Ga content may be 0.20 mass % or more and 1.00 mass % or less, or may be 0.20 mass % or more and 0.45 mass % or less. As Ga content decreases, the corrosion resistance of the R—T—B based rare earth sintered magnet tends to decrease easily. As Ga content increases, Br of the R—T—B based rare earth sintered magnet tends to decrease easily.

The R—T—B based rare earth sintered magnet may include aluminum (Al) or may not include Al. Al content may be 0.10 mass % or more and 0.50 mass % or less, or may be 0.21 mass % or more and 0.37 mass % or less. As Al content decreases, HcJ and the corrosion resistance of the R—T—B based rare earth sintered magnet tend to decrease. As Al content increases, Br of the R—T—B based rare earth sintered magnet tends to decrease easily.

The R—T—B based rare earth sintered magnet includes C. C content in the R—T—B based rare earth sintered magnet may be 0.07 mass % or more and 0.25 mass % or less, or may be 0.09 mass % or more and 0.23 mass % or less. By having C content within the above-mentioned range, the magnetic properties of the R—T—B based rare earth sintered magnet is improved, and a high Hk/HcJ tends to be attained easily. As C content decreases, it becomes difficult to attain a high Hk/HcJ. Particularly, when a sintering temperature is low, it becomes difficult to attain a high Hk/HcJ. As C content increases, HcJ tends to decrease easily.

C content in the R—T—B based rare earth sintered magnet alloy is for example, measured by a combustion in oxygen stream-infrared absorption method.

A total content of heavy rare earth elements in the R—T—B based rare earth sintered magnet may be 0.10 mass % or less (including 0). As the content of heavy rare earth elements increases, HcJ tends to increase easily while Br tends to decrease easily. In the present embodiment, the heavy rare earth elements refer to Gd, Tb, Dy, Ho, Er, Tm, Yb, and Lu.

A content of Fe and inevitable impurities may be a substantial balance of the constitution elements of the R—T—B based rare earth sintered magnet. As discussed in above, Fe content in the R—T—B based rare earth sintered magnet may be 55.00 mass % or more and 75.00 mass % or less, or may be 55.00 mass % or more and 70.58 mass % or less. Note that, a content of inevitable impurities in total may be 0.5 mass % or less (including 0).

Figure 2:
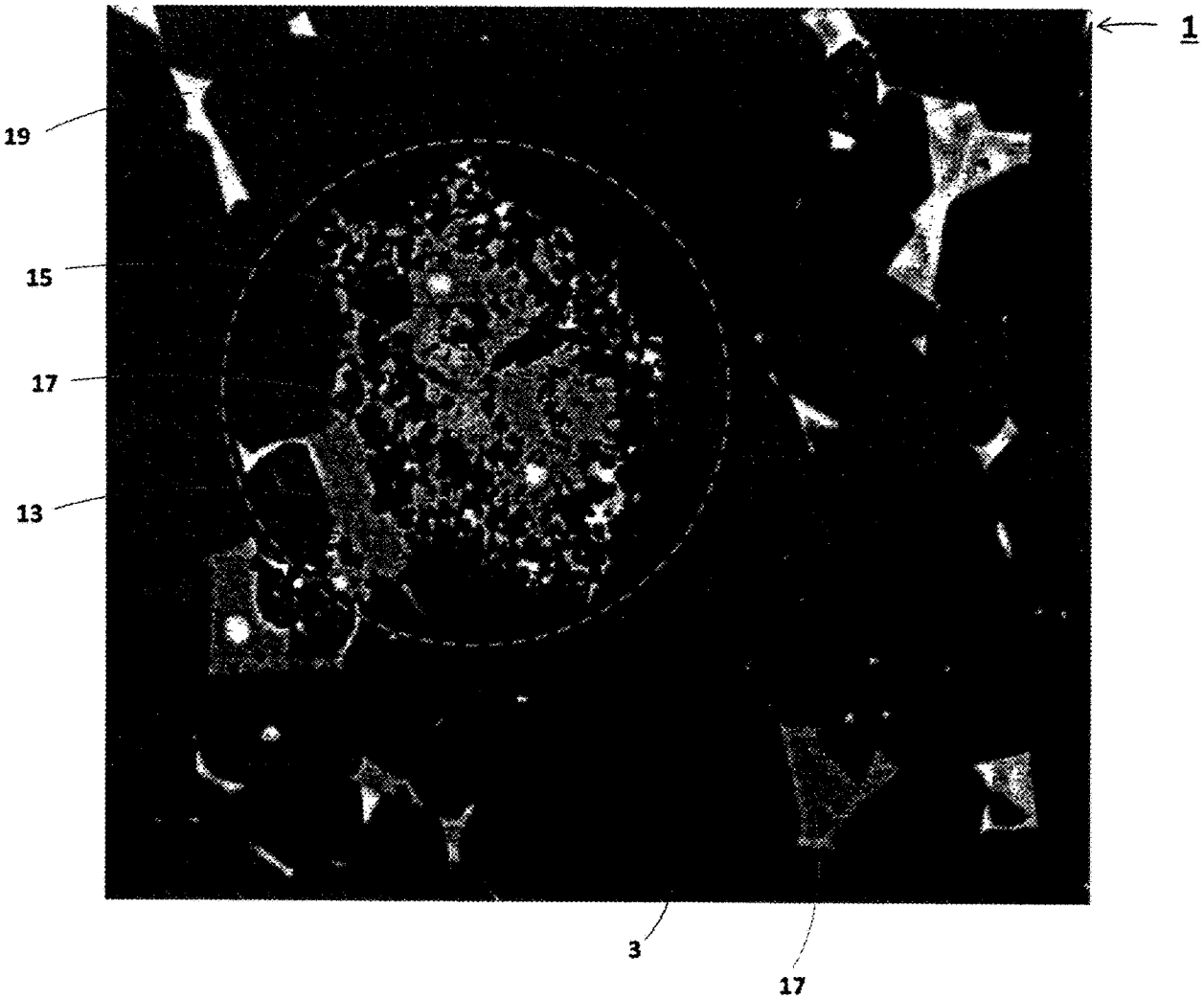
FIG. 2 is an SEM image enlarged a part of FIG. 1.

Hereinafter, an R—T—B based rare earth sintered magnet 1 according to the present embodiment is described using figures. Note that, FIG. 1 is an SEM image (compositional image) of a cross section image, and FIG. 2 is an image of which one of area containing coexisting part 100 of FIG. 1 is enlarged. Note that, FIG. 1 and FIG. 2 are SEM images observed in Example 5 which is described in below.

When one of the cross sections of the R—T—B based rare earth sintered magnet 1 is observed, for example as shown in FIG. 1 and FIG. 2, main phase grains 3 and several types of grain boundary phases existing in grain boundaries can be observed. Further, the several types of grain boundary phases have different color shades depending on each composition and different shapes depending on each crystal types.

By performing point analysis to each grain boundary phase using EPMA, the composition is determined, thereby a type of the grain boundary phase can be identified.

Further, by verifying a crystal structure of each grain boundary phase using TEM, each grain boundary phase can be clearly identified.

As shown in the SEM images of FIG. 1 and FIG. 2, the R—T—B based rare earth sintered magnet 1 includes the main phase grains 3 and grain boundaries existing between the main phase grains 3. The main phase grains 3 are mainly made of an $R_2T_{14}B$ phase. The $R_2T_{14}B$ phase has a crystal structure made of $R_2T_{14}B$ type tetragonal. The main phase grains 3 appear black in the SEM image. Each size of the main phase grains 3 is not particularly limited, and a circle equivalent diameter of the main phase grains 3 may be 1 μm to 10 μm or so. The main phase grains 3 are larger than an M—C compound 13 and an M—B compound 15 which are described below.

The grain boundaries include a triple point grain boundary and a two-grain boundary. The triple point grain boundary is a grain boundary formed between three or more main phase grains, and the two-grain boundary is a grain boundary existing between two adjacent main phase grains.

The grain boundaries at least include the M—C compound 13, the M—B compound 5, and a 6-13-1 phase 17.

The M—C compound 13 is a compound made of M and C, and it is mainly MC compound. The M—C compound 13 has a face-centered cubic structure (NaCl structure). By having the M—C compound 13 in the grain boundaries, an abnormal grain growth can be suppressed. In the SEM image, the M—C compound 13 appears black and has a granular shape. In many cases, the M—C compound 13 may appear to have approximate square shape. Also, the M—C compound 13 has a circle equivalent diameter of 0.1 to 1 μm.

The M—B compound 15 is a compound made of M and B, and it is mainly $MB_2$ compound. The M—B compound 15 has an $AlB_2$ type hexagonal crystal structure. In the SEM image, the M—B compound 15 appears black, and has a needle like shape. In many cases, the M—B compound 15 may appear to have approximate rectangular shape. By having the M—B compound 15 in the grain boundaries, the abnormal grain growth can be suppressed. Also, a length of longitudinal side of the M—B compound 15 may be 0.3 to 3.5 μm.

The 6-13-1 phase 17 includes an $R_6T_{13}M'$ compound which is a compound having a $La_6Co_{11}Ga_3$ type crystal structure. Here, a type of M' is not particularly limited. For example, Ga, Al, Cu, Zn, In, P, Sb, Si, Ge, Sn, Bi, and the like may be mentioned. Also, the 6-13-1 phase 17 may include an $R_6T_{13}Ga$ compound including Ga as M'. In the SEM image, the 6-13-1 phase 17 appears gray.

The R—T—B based rare earth sintered magnet 1 includes the coexisting part in the grain boundaries, and the M—C compound 13, the M—B compound 15, and the 6-13-1 phase 17 coexist in the coexisting part. By having the coexisting part, the amount of the grain boundaries formed is increased in the R—T—B based rare earth sintered magnet 1, and HcJ improves. FIG. 1 and FIG. 2 show the area containing coexisting part 100 which includes the coexisting part.

Regarding each M—C compound 13 in the coexisting part, 50% or more of an outer circumference of the M—C compound 13 is surrounded by other M—C compound 13, the M—B compound 15, and/or the 6-13-1 phase 17 in the same coexisting part. Regarding each M—B compound 15, 50% or more of an outer circumference of the M—B compound 15 is surrounded by the M—C compound 13, other M—B compound 5, and/or the 6-13-1 phase 17 in the same coexisting part.

The M—C compound 13 does not necessarily have to be in contact with the other M—C compound 13, the M—B compound 15, and/or the 6-13-1 phase 17 which are surrounding the M—C compound 13. For example, other parts of the grain boundaries may exist in a width of 1000 nm or less between the M—C compound 13 and other M—C compound 13, the M—B compound 15, and/or the 6-13-1 phase 7 which are surrounding the M—C compound 13.

An area of each coexisting part is 200 $\mu m^2$ or less respectively. The area of the coexisting part is calculated by an image analysis based on a contrast difference in the SEM image.

An area ratio of the coexisting part in the cross section of the R—T—B based rare earth sintered magnet 1 may be 0.10% or more and 15.00% or less, or may be 0.25% or more and 10.13% or less. As the area ratio of the coexisting part increases, HcJ tends to improve easily. When the area ratio of the coexisting part is larger than 10.13%, as the area ratio of the coexisting part increases, HcJ tends to decrease easily, and Br and Hk/HcJ tend to decrease easily.

A total area ratio of the M—B compound 15 and the M—C compound 13 in the coexisting part may be 40% or more and 75% or less. An area ratio of the 6-13-1 phase 17 in the coexisting part may be 25% or more and 60% or less. An area ratio of the M—C compound 13 in the coexisting part may be 30% or more and 70% or less, and an area ratio of the M—B compound 15 in the coexisting part may be 5% or more and 10% or less. By having area ratios of each of the compounds and the 6-13-1 phase in the coexisting part within the above-mentioned ranges, HcJ tends to be improved easily.

In order to calculate the area ratios of the M—B compound, the M—C compound, and the 6-13-1 phase, at least three images are analyzed which are obtained by observing an observation area of 100 μm×100 μm at a magnification of 1500×, thereby the area ratios are obtained.

The grain boundaries 11 may include other parts besides the above-mentioned M—B compound 15, M—C compound 13, and 6-13-1 phase 17. For example, as shown in FIG. 1 and FIG. 2, an R-rich phase 19 in which R content ratio is 40 at % or more may be included. The R-rich phase 19 appears whiter than the 6-13-1 phase 17 in the SEM image.

Method of Producing R—T—B Based Rare Earth Sintered Magnet

An example of a method of producing the R—T—B based rare earth sintered magnet according to the present embodiment is described. The method of producing the R—T—B based rare earth sintered magnet (R—T—B based sintered magnet) includes following steps.

(a) An alloy preparation step preparing an R—T—B based rare earth sintered magnet alloy (raw material alloy).

(b) A pulverization step pulverizing the raw material alloy.

(c) An adding and mixing step of M powder to an obtained alloy powder.

(d) A compacting step an obtained alloy powder is compacted.

(e) A sintering step wherein a green compact is sintered to obtain the R—T—B based rare earth sintered magnet.

(f) An aging step carrying out an aging treatment to the R—T—B based rare earth sintered magnet.

(g) A cooling step cooling the R—T—B based rare earth sintered magnet.

(h) A machining step wherein the R—T—B based rare earth sintered magnet is machined.

(i) A grain boundary diffusion step wherein a heavy rare earth element is diffused into the R—T—B based rare earth sintered magnet.

(j) A surface treatment step wherein the R—T—B based rare earth sintered magnet is surface treated.

Alloy Preparation Step

The R—T—B based rare earth sintered magnet alloy is prepared (alloy preparation step). Hereinafter, as one example of the alloy preparation method, a strip casting method is described, however the alloy preparation method is not limited thereto.

Raw material metals corresponding to the composition of the R—T—B based rare earth sintered magnet are prepared and melted in vacuum or in inert gas such as Ar gas and the like. Then, the melted raw material metals are casted to produce the raw material alloy which becomes the raw material of the R—T—B based rare earth sintered magnet. Note that, in the present embodiment, a one-alloy method is described, however a two-alloy method in which two alloys, that is a first alloy and a second alloy are mixed to produce a raw material powder, may be used.

A type of the raw material metals is not particularly limited. For example, rare earth metals or alloy of rare earth metals, pure iron, pure cobalt, ferro-boron, alloys and compounds of these, and the like can be used. A method of casting the raw material metals is not particularly limited. For example, an ingot casting method, a strip casting method, a book molding method, a centrifugal casting method, and the like may be mentioned. When solidification segregation exists in the obtained raw material alloy, a homogenization treatment (solution treatment) may be carried out if needed. C content in the raw material alloy may be 0.01 mass % or more, or it may be 0.1 mass % or more. Upper limit of C content in the raw material alloy is not particularly limited. For example, it may be 0.2 mass % or less.

Pulverization Step

After the raw material alloy has been produced, it is pulverized (pulverization step). The pulverization step may be carried out in two-steps which includes a coarse pulverization step pulverizing until a particle size is several hundred 1 μm to several mm or so, and a fine pulverization step pulverizing until a particle size is several 1 μm or so. However, the pulverization step may be carried out in one-step which is only the fine pulverization step.

Coarse Pulverization Step

The raw material alloy is coarsely pulverized until the particle size is several hundred 1 μm to several mm or so (coarse pulverization step). Thereby, a coarsely pulverized powder of the raw material alloy is obtained. As an example, after hydrogen is stored in the raw material alloy, hydrogen is released due to a different hydrogen storage amount between different phases, and dehydrogenation is carried out which causes a self-collapsing like pulverization (hydrogen storage pulverization); thereby the coarse pulverization can be carried out. A condition of dehydrogenation is not particularly limited, and for example it may be carried out under 300 to 650° C. in argon flow or vacuum.

The method of coarse pulverization is not limited to the above-mentioned hydrogen storage pulverization. For example, the coarse pulverization step may be carried out by using a coarse pulverizer such as a stamp mill, a jaw crusher, a brown mill, and the like, in inert gas atmosphere.

In order to obtain the R—T—B based rare earth sintered magnet with high magnetic properties, the atmosphere can be set to a low oxygen concentration for each step from the coarse pulverization step to the sintering step described below. The oxygen concentration is adjusted by regulating the atmosphere of each production step. If the oxygen concentration of each production step is high, the rare earth elements in the alloy powder obtained by pulverizing the raw material alloy may be oxidized and may produce oxides of R. The oxides of R are not deoxidized during sintering and precipitate in the grain boundaries as oxides of R. As a result, Br of the obtained R—T—B based rare earth sintered magnet decreases. Therefore, for example, each step (the fine pulverization step and the compacting step) can be performed in the atmosphere having the oxygen concentration of 100 ppm or less.

Fine Pulverization Step

After coarsely pulverizing the raw material alloy, the obtained coarsely pulverized powder of the raw material alloy is finely pulverized until an average particle size is several μm or so (fine pulverization step). Thereby, a finely pulverized powder of the raw material alloy is obtained. D50 of the particles included in the finely pulverized powder is not particularly limited. For example, D50 may be 2.0 μm or more and 4.5 μm or less, or may be 2.5 μm or more and 3.5 μm or less. As D50 decreases, HcJ of the R—T—B based rare earth sintered magnet tends to improve easily. However, the abnormal grain growth tends to occur easily during the sintering step, and the upper limit of a sintering temperature decreases. As D50 increases, the abnormal grain growth is suppressed during the sintering step, hence the upper limit of the sintering temperature increases. However, HcJ of the R—T—B based rare earth sintered magnet tends to decrease easily.

The fine pulverization is carried out by further pulverizing the coarsely pulverized powder using a fine pulverizer such as a jet mill, a ball mill, a vibrating mill, a wet attritor, and the like while regulating the conditions such as a pulverization time and the like accordingly. Hereinbelow, a jet mill is described. A jet mill is a machine for pulverization wherein a high-pressure inert gas (for example, He gas, $N_2$ gas, Ar gas, and the like) is released from a narrow nozzle to generate a high speed gas flow, and this high speed gas flow accelerates the coarsely pulverized powder of the raw material alloy to collide against each other or collide the coarsely pulverized powder of the raw material alloy to a target or a container wall.

When the coarsely pulverized powder of the raw material alloy is finely pulverized, a pulverization aid may be added. A type of the pulverization aid is not particularly limited. For example, an organic lubricant, a solid lubricant, and the like may be used. As the organic lubricant, oleic amide, lauric amide, zinc stearate, and the like may be mentioned. As the solid lubricant, for example graphite and the like may be mentioned. By adding the pulverization aid, the finely pulverized powder with high orientation can be obtained in the compacting step while applying magnetic field. Either one of the organic lubricant or the solid lubricant may be used, but these may be mixed to use both. This is because if the solid lubricant is only used, the degree of orientation may decrease in some case.

M powder is added to the finely pulverized powder obtained from the fine pulverization step. Particle sizes of 99% or more of the particles in terms of number ratio of added M powder may be 1.0 μm or more and 45 μm or less. After M powder is added to the finely pulverized powder, these can be mixed using a mixer, however a method of mixing the finely pulverized powder and M powder is not particularly limited.

M powder is a powder in which Zr, Ti, and Nb are total of 80% or more based on mass. Also, elements other than M may be included within a range of 20% or less. As the elements other than M, for example, R, Fe, Ga, Cu, Co, Al, Zn, In, P, Sb, Si, Ge, Sn, Bi, and the like may be mentioned. Also, a powder including oxides of M may be used as M powder.

Compacting Step

The finely pulverized powder is compacted into a desired shape (compacting step). In the compacting step, the finely pulverized powder is filled in a mold placed in a magnetic field and then pressure is applied, thereby the finely pulverized powder is compacted and a green compact is obtained. By applying pressure while applying a magnetic field, a predetermined orientation of the finely pulverized powder is formed, and compacting is done in the magnetic field while crystal axis is oriented. The obtained green compact is oriented in a specific direction; hence the R—T—B based rare earth sintered magnet having even higher magnetic anisotropy is obtained. A compacting aid may be added during compacting. A type of the compacting aid is not particularly limited. The same lubricant as the pulverization aid may be used. Also, the pulverization aid may also function as the compacting aid.

Pressure of 30 MPa or more and 300 MPa or less may be applied during compacting. Magnetic field of 1000 kA/m to 1600 kA/m may be applied. The applied magnetic field is not limited to a static magnetic field, and it can be a pulse magnetic field. The static magnetic field and the pulse magnetic field can be used together.

As a compacting method, other than dry compacting in which the finely pulverized powder is directly compacted as described in above, wet compacting can be applied in which a slurry obtained by dispersing the finely pulverized powder in a solvent such as oil is compacted.

The shape of the green compact obtained by compacting the finely pulverized powder is not particularly limited, and for example, it can be any shape depending on the desired shape of the R—T—B based rare earth sintered magnet such as a rectangular parallelepiped shape, a flat plate shape, a columnar shape, a ring shape, C shape and the like.

Sintering Step

The obtained green compact is sintered in vacuum or inert gas atmosphere thereby the R—T—B based rare earth sintered magnet is obtained (sintering step). A holding temperature during sintering needs to be regulated depending on various conditions such as a composition, a pulverization method, a difference between average particle size and particle size distribution, and the like. The holding temperature is a temperature which does not cause abnormal grain growth and also attains sufficiently high Hk/HcJ. The holding temperature is not particularly limited, and for example, it may be 1000° C. or higher and 1150° C. or lower, or may be 1050° C. or higher and 1130° C. or lower. A holding time is not particularly limited, and for example it may be 2 hours or more and 10 hours or less, or may be 2 hours or more and 8 hours or less. As the holding time becomes shorter, a production efficiency increases. Atmosphere while holding is not particularly limited. For example, it may be an inert gas atmosphere, may be a vacuum atmosphere of less than 100 Pa, or may be a vacuum atmosphere of less than 10 Pa. A heating rate until reaching the holding temperature is not particularly limited. The finely pulverized powder undergoes a liquid phase sintering by sintering, and the R—T—B based rare earth sintered magnet (a sintered body of the R—T—B based magnet) is obtained. After obtaining the sintered body by sintering the green compact, a cooling rate is not particularly limited, and the sintered body may be quenched in order to improve the production efficiency. A quenching rate may be 20° C./min or faster.

Aging Treatment Step

After the green compact is sintered, an aging treatment is performed to the R—T—B based rare earth sintered magnet (aging treatment step). After sintering, the obtained R—T—B based rare earth sintered magnet is kept at a temperature lower than in the sintering step, thereby the aging treatment is performed to the R—T—B based rare earth sintered magnet. Hereinafter, the aging treatment which is carried out in two-step of a first aging treatment and a second aging treatment is described. However, the aging treatment may be carried out by either one of the aging treatments or may be carried out in three or more steps.

The holding temperature and the holding time in each aging treatment are not particularly limited. For example, the first aging treatment may be performed at the holding temperature of 800° C. or more and 950° C. or less for 30 minutes or more and 4 hours or less. A temperature increasing rate up until reaching to the holding temperature may be 5° C./min or more and 50° C./min or less. An atmosphere during the first aging treatment may be an inert gas atmosphere (for example, He gas and Ar gas) of which a pressure is atmospheric pressure or higher. The second aging treatment may be performed under the same condition as the first aging treatment except for having a holding temperature of 450° C. or higher and 550° C. or lower. By carrying out aging treatment, the magnetic properties of the R—T—B based rare earth sintered magnet can be improved. Also, the aging treatment step may be performed after the below described machining step.

Cooling Step

After carrying out the aging treatments (the first aging treatment and the second aging treatment) to the R—T—B based rare earth sintered magnet, the R—T—B based rare earth sintered magnet is quenched in Ar gas atmosphere (cooling step). Thereby, the R—T—B based rare earth sintered magnet can be obtained. The cooling rate is not particularly limited, and it may be 15° C./min or more.

Machining Step

The obtained R—T—B based rare earth sintered magnet may be machined into a desired shape when required (machining step). The method of machining may be, for example, a shaping process such as cutting, grinding, and the like; a chamfering process such as barrel polishing; and the like.

Grain Boundary Diffusion Step

The heavy rare earth elements may be further diffused to the grain boundaries of the machined R—T—B based rare earth sintered magnet (grain boundary diffusion step). A method of grain boundary diffusion is not particularly limited. For example, a compound including the heavy rare earth elements may be applied on the surface of the R—T—B based rare earth sintered magnet by coating, deposition, and the like, and then the heat treatment may be carried out, thereby the grain boundary diffusion may be performed. The R—T—B based rare earth sintered magnet may be heat treated in the atmosphere including vapor of heavy rare earth elements, thereby the grain boundary diffusion may be performed. The R—T—B based rare earth sintered magnet can further enhance HcJ by performing the grain boundary diffusion.

Surface Treatment Step

The R—T—B based rare earth magnet obtained by the above-mentioned steps may be further performed with a surface treatment such as a plating treatment, a resin coating treatment, an oxidizing treatment, a chemical treatment, and the like (surface treatment step). By performing the surface treatment step, a corrosion resistance can be further improved.

In the present embodiment, the machining step, the grain boundary diffusion step, and the surface treatment step are performed, however, these steps do not necessarily have to be performed.

The R—T—B based rare earth sintered magnet obtained as mentioned in above has particularly good HcJ, and further has high Br and Hk/HcJ.

By adding M powder to the finely pulverized powder, the obtained R—T—B based rare earth sintered magnet includes the above-mentioned coexisting part. A mechanism of how the coexisting part is formed in the R—T—B based rare earth sintered magnet is not necessarily clear, however by adding M powder in the finely pulverized powder, M is to be included in the grain boundaries of the green compact. The grain boundaries also include the pulverization aid which is adhered to the finely pulverized powder. As a result, during sintering, it is thought that M included in the grain boundaries has a priority to react with C included in the pulverization aid and B included in the main phase grains. It is thought that such reaction forms the coexisting part in which the M—C compound, the M—B compound, and the 6-13-1 phase coexist.

When M powder is not added, C included in the pulverization aid forms an R—O—C—N compound and the like by reacting with R and the like included in the main phase grains in the grain boundaries (mainly in the triple point grain boundary). The R—O—C—N compound and the like decreases HcJ. In the R—T—B based rare earth sintered magnet according to the present embodiment, the above-mentioned coexisting part is generated instead of the reaction between R and the like with C included in the pulverization aid, thus R and the like becomes difficult to react with C included in the pulverization aid, and compounds such as the R—O—C—N compound, which decreases HcJ, are less likely to be formed. Further, the R-rich phases are formed by excess R which is left due to the reaction between M and C included in the pulverization aid forming the M—C compound. The R-rich phases is also formed in the two-grain boundary, thus the two-grain boundary becomes thicker and HcJ tends to improve easily.

Also, by forming the M—B compound as a result of the reaction between M and part of B forming the main phase grain, part of the main phase grain is disintegrated. As a result, R included in the main phase grains is formed in the grain boundaries. Thus, the R-rich phases increase, and the two-grain boundary becomes thicker and HcJ improves.

The present invention is not limited to the above described embodiment and can be variously modified within the scope of the present invention.

EXAMPLES

Hereinafter, the present invention is described based on further detailed examples, however, the present invention is not limited thereto.

Alloy Preparation Step

As a raw material alloy, an alloy 1 and an alloy 2 having the composition shown in Table 1 were prepared. Note that, T.RE shown in Tables 1 and 2 refers to a total content of Nd, Pr, Dy, and Tb. The total content of Dy and Tb in each alloy composition was less than 0.01 mass %.

First, raw material metals were prepared. The raw material metals were prepared by suitably selecting a simple substance of metal shown in Table 1 or a compound such as an alloy including elements shown in Table 1.

Next, these raw material metals were weighed to obtain the alloy having the composition shown in Table 1, then the raw material alloy was prepared by a strip casting method. Note that, a content of carbon was controlled by varying a ratio of pig iron used in the raw material metals. Also, in each experiment example, the raw material alloy shown in Table 2 was selected.

Pulverization Step

The raw material alloy obtained by the alloy preparation step was pulverized and an alloy powder was obtained. Pulverization was performed in two steps which are a coarse pulverization and a fine pulverization. The coarse pulverization was performed by a hydrogen storage pulverization. Hydrogen was stored in the raw material alloy at 600° C., then dehydrogenation was performed in argon flow or in vacuum at 600° C. for 3 hours. The alloy powder having a grain size of several μm or so to several mm or so was obtained by the coarse pulverization.

The fine pulverization was performed using a jet mill after adding and mixing 0.10 parts by mass of zinc stearate as a pulverization aid to 100 parts by mass of the alloy powder obtained by the coarse pulverization. Nitrogen gas was used for the jet mill. Regarding Examples 1 to 4 and Comparative example 1, the fine pulverization was performed until D50 of the alloy powder was 3.0 μm or so. Regarding Example 5 and Comparative example 2, the fine pulverization was performed until D50 was 4.0 μm or so.

Next, for each Experiment example, 120 g of the finely pulverized powder was prepared and Zr powder was added to the finely pulverized powder. An added amount of Zr powder with respect to 100 parts by mass of the finely pulverized powder is shown in Table 2. Regarding Comparative examples 1 and 2, Zr powder was not added. Also, in regards with the added Zr powder, at least 99% of the powder particles in terms of number ratio had a grain size of 1.0 μm or more and 35 μm or less. Further, after adding Zr powder to the finely pulverized powder, these were mixed using a mixer and a mixed powder was obtained.

Compacting Step

The mixed powder obtained by the pulverization step was compacted in a magnetic field, and a green compact was obtained. The mixed powder was filled in a mold placed between electromagnets, and then a pressure was applied while applying a magnetic field, thereby compacting was performed. Specifically, 20 g of the mixed powder was weighed and compacted under a magnetic field of 3T and a pressure of 40 kN.

Sintering Step

The obtained green compact was sintered to obtain a sintered body. A holding temperature while sintering in each Example and Comparative example was set to 1070° C., thereby the sintered boy was obtained. A temperature increasing rate while increasing to the holding temperature was 8.0° C./min, a holding time was 4.0 hours, and a cooling rate from the holding temperature to room temperature was 50° C./min. Sintering was performed under vacuumed atmosphere or under inert gas atmosphere.

Aging Treatment Step

The obtained sintered body was performed with an aging treatment to obtain the R—T—B based rare earth sintered magnet. The aging treatment was performed in two steps of a first aging treatment and a second aging treatment.

In the first aging treatment, a temperature increasing rate while increasing to the holding temperature was 8.0° C./min, a holding temperature was 900° C., a holding time was 1.0 hour, and a temperature decreasing rate from the holding temperature to room temperature was 50° C./min. The first aging treatment was performed under Ar atmosphere.

In the second aging treatment, a temperature increasing rate while increasing to the holding temperature was 8.0° C./min, a holding temperature was 500° C., a holding time was 1.5 hours, and a temperature decreasing rate from the holding temperature to room temperature was 50° C./min. The second aging treatment was performed under Ar atmosphere.

Evaluation

An X-ray fluorescence analysis, an inductively coupled plasma atomic emission spectroscopy (ICP analysis), and a gas analysis were used for a composition analysis to verify that the R—T—B based rare earth sintered magnet of each Example and Comparative example had a composition shown in Table 2. Particularly, a content of carbon was measured by a combustion in oxygen stream-infrared absorption method.

Magnetic properties of the R—T—B based rare earth sintered magnet made from the raw material alloy of each Example and Comparative example were measured by a BH tracer. As the magnetic properties, Br, HcJ, and Hk/HcJ were measured at room temperature. In the present examples, Hk was the value of the magnetic field when the magnetization was Br×0.9. Results are shown in Table 2.

In the R—T—B based rare earth sintered magnet of the present examples, the composition of the R—T—B based rare earth sintered magnet differed depending on which raw material alloys of alloy 1 was used or alloy 2 was used. Particularly, B content differed largely. Thus, magnetic properties of the R—T—B based rare earth sintered magnet cannot be evaluated by the same evaluation standard for the case using alloy 1 and for the case using alloy 2.

When the alloy 1 was used, Br of 1300 mT or more was considered good, and 1350 mT or more was considered even better. HcJ of 1600 kA/m or more was considered good, and 1700 kA/m or more was considered even better. Hk/HcJ of 85.00% or more was considered good, and 95.00% or more was considered even better.

When the alloy 2 was used, Br of 1440 mT or more was considered good. HcJ of 1250 kA/m or more was considered good. Hk/HcJ of 95.00% or more was considered good.

Regarding an area ratio of a coexisting part, a cross section of the R—T—B based rare earth sintered magnet of each example was observed using SEM under a magnification of 1500×. A size of the observation area was 100 μm×100 μm. This observation was performed three times at different areas, and the obtained three SEM images were performed with image analysis to verify the coexisting part. Thereby, the area ratio of the coexisting part was calculated. Results are shown in Table 2. Note that, FIG. 1 and FIG. 2 are one of SEM images of Example 5.

In Examples 1 to 3, one of the coexisting parts was taken and an area ratio of each phase was verified. Results are shown in Table 3.

TABLE 1

| Raw material | Alloy composition | | | | | | | | | | (mass %) |
|---|---|---|---|---|---|---|---|---|---|---|---|
| Alloy | T.RE | Nd | Pr | Al | Co | Cu | Zr | Ga | B | C | Fe |
| Alloy 1 | 31.20 | 24.92 | 6.28 | 0.37 | 2.00 | 0.30 | 0.50 | 0.45 | 0.83 | 0.13 | Bal. |
| Alloy 2 | 29.70 | 23.70 | 6.00 | 0.21 | 2.00 | 0.19 | 0.21 | 0.20 | 0.94 | 0.01 | Bal. |

TABLE 2

| | | Zr added | | | | | | | | | | | | Coexisting part | | Magnetic properties | | |
|---|---|---|---|---|---|---|---|---|---|---|---|---|---|---|---|---|---|---|
| | Raw | amount (mass | Magnet composition (mass %) | | | | | | | | | | | Pres- | Area ratio | Br | HcJ | Hk/HcJ |
| Example | alloy | %) | T.RE | Nd | Pr | Al | Co | Cu | Zr | Ga | B | C | Fe | ence | (%) | (mT) | (kA/m) | (%) |
| Comparative example 1 | Alloy 1 | 0.00 | 31.20 | 24.92 | 6.28 | 0.37 | 2.00 | 0.30 | 0.50 | 0.45 | 0.83 | 0.23 | Bal. | None | 0 | 1405 | 1512 | 99.12 |
| Example 1 | Alloy 1 | 0.60 | 31.01 | 24.77 | 6.24 | 0.37 | 1.99 | 0.30 | 1.10 | 0.45 | 0.83 | 0.23 | Bal. | Exist | 0.25 | 1383 | 1691 | 98.78 |
| Example 2 | Alloy 1 | 0.80 | 30.95 | 24.72 | 6.23 | 0.37 | 1.98 | 0.30 | 1.30 | 0.45 | 0.82 | 0.23 | Bal. | Exist | 8.32 | 1374 | 1710 | 98.30 |
| Example 3 | Alloy 1 | 1.10 | 30.86 | 24.65 | 6.21 | 0.37 | 1.98 | 0.30 | 1.60 | 0.45 | 0.82 | 0.23 | Bal. | Exist | 10.13 | 1362 | 1729 | 97.00 |
| Example 4 | Alloy 1 | 1.40 | 30.77 | 24.58 | 6.19 | 0.36 | 1.97 | 0.30 | 1.89 | 0.44 | 0.82 | 0.23 | Bal. | Exist | 12.11 | 1330 | 1683 | 86.78 |
| Comparative example 2 | Alloy 2 | 0.00 | 29.70 | 23.70 | 6.00 | 0.21 | 2.00 | 0.19 | 0.21 | 0.20 | 0.94 | 0.09 | Bal. | None | 0 | 1474 | 1207 | 98.97 |
| Example 5 | Alloy 2 | 0.50 | 29.55 | 23.58 | 5.97 | 0.21 | 1.99 | 0.19 | 0.71 | 0.20 | 0.94 | 0.09 | Bal. | Exist | 1.38 | 1447 | 1258 | 98.70 |

TABLE 3

| | Area ratio | | |
|---|---|---|---|
| | 6-13-1 phase | Zr-C compound | Zr-B compound |
| Example 1 | 60% | 35% | 6% |
| Example 2 | 34% | 57% | 9% |
| Example 3 | 28% | 66% | 6% |

According to Table 2, among Examples 1 to 4 and Comparative example 1 which were performed under the same condition except for varying the amount of Zr added, the coexisting part existed in all of the R—T—B based rare earth sintered magnets except for Comparative example 1 which was not added with Zr. The R—T—B based rare earth sintered magnets of Examples 1 to 4 had a high HcJ while maintaining good Br and Hk/HcJ compared to Comparative example 1.

Examples 1 to 3 in which the area ratio of the coexisting part was 0.25% or more and 10.13% or less had good Br and Hk/HcJ compared to Example 4 in which the area ratio of the coexisting part was 12.11%.

Among Example 5 and Comparative example 2 which were performed under the same condition except for varying the amount of added Zr, the R—T—B based rare earth sintered magnet of Comparative example 2 which was not added with Zr did not have the coexisting part, and the R—T—B based rare earth sintered magnet of Example 5 which was added with Zr had the coexisting part. The R—T—B based rare earth sintered magnet of Example 5 had a high HcJ while maintaining good Br and Hk/HcJ compared to Comparative example 1.

According to Table 3, it was confirmed that, in the R—T—B based rare earth sintered magnet of Examples 1 to 3, a total area ratio of the Zr—B compound and the Zr—C compound in the coexisting part was 40% or more 75% or less; an area ratio of the Zr—C compound was 30% or more and 70% or less; an area ratio of the Zr—B compound was 5% or more and 10% or less; and an area ratio of the 6-13-1 phase was 25% or more and 60% or less. The same was confirmed for the coexisting part included in the R—T—B based rare earth sintered magnet of Example 4.

In Example 5, it was confirmed that, in the coexisting part, a total area ratio of the Zr—B compound and the Zr—C compound was 40% or more and 75% or less; an area ratio of the Zr—C compound was 5% or more and 15% or less; an area ratio of the Zr—B compound was 25% or more and 70% or less; and an area ratio of the 6-13-1 phase was 25% or more and 60% or less. Example 5 had a larger area ratio of Zr—B compound compared to Examples 1 to 4, this is because Example 5 had a larger B content compared to Examples 1 to 4.

NUMERICAL REFERENCES

1 . . . R—T—B based rare earth sintered magnet
3 . . . Main phase grain
13 . . . M—C compound
15 . . . M—B compound
17 . . . 6-13-1 phase
19 . . . R-rich phase
100 . . . Area containing coexisting part

What is claimed is:

1. An R—T—B based rare earth sintered magnet comprising M and C in which R is a rare earth element, T is an iron group element, and B is boron, wherein R includes one or more selected from Nd and Pr;

M is one or more selected from Zr, Ti, and Nb; and the R—T—B based rare earth sintered magnet includes main phase grains and grain boundaries, and the grain boundaries include a coexisting part in which an M—C compound, an M—B compound, and a 6-13-1 phase coexist.

2. The R—T—B based rare earth sintered magnet according to claim 1 wherein with respect to 100 mass % of the R—T—B based rare earth sintered magnet, a total content of R is 28.00 mass % or more and 34.00 mass % or less;

Co content is 0.05 mass % or more and 3.00 mass % or less;

B content is 0.70 mass % or more and 0.95 mass % or less;

C content is 0.07 mass % or more and 0.25 mass % or less;

Cu content is 0.10 mass % or more and 0.50 mass % or less;

Ga content is 0.20 mass % or more and 1.00 mass % or less;

Al content is 0.10 mass % or more and 0.50 mass % or less;

a total content of M is 0.20 mass % or more and 2.00 mass % or less; and a total content of heavy rare earth elements is 0.10 mass % or less (including 0).

3. The R—T—B based rare earth sintered magnet according to claim 1, wherein an area ratio of the coexisting part in one cross section of the R—T—B based rare earth sintered magnet is 0.10% or more and 15.00% or less.

4. The R—T—B based rare earth sintered magnet according to claim 1, wherein a total area ratio of the M—B compound and the M—C compound in the coexisting part is 40% or more and 75% or less, and an area ratio of the 6-13-1 phase in the coexisting part is 25% or more and 60% or less.

5. The R—T—B based rare earth sintered magnet according to claim 4, wherein an area ratio of the M—C compound is 30% or more and 70% or less, and an area ratio of the M—B compound is 5% or more and 10% or less.

* * * * *